US006221820B1

(12) United States Patent
Lietzmann et al.

(10) Patent No.: US 6,221,820 B1
(45) Date of Patent: Apr. 24, 2001

(54) GRANULAR COMPONENT CONTAINING ALKYLAMINOTRIAZOLE FOR USE IN MACHINE DISHWASHING DETERGENTS

(75) Inventors: Andreas Lietzmann, Duesseldorf; Thomas Holderbaum, Monheim; Peter Jeschke, Neuss; Juergen Haerer, Duesseldorf, all of (DE)

(73) Assignee: Henkel Kommanditgesellschaft auf Aktien, Dusseldorf (DE)

( * ) Notice: Subject to any disclaimer, the term of this patent is extended or adjusted under 35 U.S.C. 154(b) by 0 days.

(21) Appl. No.: 09/223,143

(22) Filed: Dec. 30, 1998

(30) Foreign Application Priority Data

Dec. 31, 1997 (DE) ..... 197 58 262

(51) Int. Cl.[7] ..... C11D 7/04; C11D 7/32

(52) U.S. Cl. ..... 510/224; 510/228; 510/445; 510/446; 510/492; 510/500

(58) Field of Search ..... 510/221, 224, 510/228, 433, 445, 446, 492, 500; 134/25.2

(56) References Cited

U.S. PATENT DOCUMENTS

| | | | | |
|---|---|---|---|---|
| 4,101,456 | | 7/1978 | Renaud et al. | 252/551 |
| 4,321,166 | | 3/1982 | McGrady | 252/542 |
| 5,798,326 | * | 8/1998 | Goldstein et al. | 510/221 |

FOREIGN PATENT DOCUMENTS

| | | |
|---|---|---|
| 26 16 404 | 10/1976 | (DE) . |
| 41 28 672 | 3/1993 | (DE) . |
| 43 25 922 | 2/1995 | (DE) . |
| 43 38 724 | 5/1995 | (DE) . |
| 44 16 438 | 11/1995 | (DE) . |
| 44 43 177 | 6/1996 | (DE) . |
| 195 29 905 | 2/1997 | (DE) . |
| 195 36 082 | 4/1997 | (DE) . |
| 196 05 688 | 8/1997 | (DE) . |
| 196 13 103 | 10/1997 | (DE) . |
| 196 20 411 | 10/1997 | (DE) . |
| 196 16 693 | 11/1997 | (DE) . |
| 196 16 767 | 11/1997 | (DE) . |
| 196 16 769 | 11/1997 | (DE) . |
| 196 16 770 | 11/1997 | (DE) . |
| 196 20 267 | 11/1997 | (DE) . |
| 196 31 787 | 2/1998 | (DE) . |
| 197 01 031 | 7/1998 | (DE) . |
| 0 167 382 | 1/1986 | (EP) . |
| 0 272 030 | 6/1988 | (EP) . |
| 0 342 997 | 11/1989 | (EP) . |
| 0 392 592 | 10/1990 | (EP) . |
| 0 443 651 | 8/1991 | (EP) . |
| 0 446 982 | 9/1991 | (EP) . |
| 0 453 003 | 10/1991 | (EP) . |
| 0 458 397 | 11/1991 | (EP) . |
| 0 458 398 | 11/1991 | (EP) . |
| 0 467 472 | 1/1992 | (EP) . |
| 0 525 239 | 2/1993 | (EP) . |
| 0 544 490 | 6/1993 | (EP) . |
| 0 544 519 | 6/1993 | (EP) . |
| 0 549 271 | 6/1993 | (EP) . |
| 0 549 272 | 6/1993 | (EP) . |
| 0 693 550 | 1/1996 | (EP) . |
| 1 400 444 | 7/1975 | (GB) . |
| WO94./28103 | 12/1994 | (WO) . |
| WO94/27970 | 12/1994 | (WO) . |
| WO94/28102 | 12/1994 | (WO) . |
| WO95/00626 | 1/1995 | (WO) . |
| WO95/01416 | 1/1995 | (WO) . |
| WO95/14075 | 5/1995 | (WO) . |
| WO95/14759 | 6/1995 | (WO) . |
| WO95/17498 | 6/1995 | (WO) . |
| WO95/27775 | 10/1995 | (WO) . |

OTHER PUBLICATIONS

Z.B. in SOEFW–Journal, 119 (1993), 794–808.

Derwent Patent Abstract (WPAT) No. 98–121352/12 (Apr. 1998).

Derwent Patent Abstract (WPAT) No. 98–389024/34 (Jul. 1998).

Derwent Patent Abstract (WPAT) No. 97–551016/51 (Nov. 1997).

Derwent Patent Abstract (WPAT) No. 97–551018/51 (Apr. 1997).

Derwent Patent Abstract (WPAT) No. 97–537244/50 (Nov. 1997).

Derwent Patent Abstract (WPAT) No. 97–537245/50 (Nov. 1997).

Derwent Patent Abstract (WPAT) No. 96–287166/29 (Jun. 1996).

Derwent Patent Abstract (WPAT) No. 95–186717/25 (May 1995).

Derwent Patent Abstract (WPAT) No. 97–133790/13 (Feb. 1997).

Derwent Patent Abstract (WPAT) No. 98–019669/03 (Nov. 1997).

Derwent Patent Abstract (WPAT) No. 97–204334/19 (Apr. 1997).

Derwent Patent Abstract (WPAT) No. 97–416938/39 (Aug. 1997).

Derwent Patent Abstract (WPAT) No. 97–481969/45 (Oct. 1997).

(List continued on next page.)

*Primary Examiner*—Gregory N. DelCotto
(74) *Attorney, Agent, or Firm*—Wayne C. Jaeschke; Glenn E. J. Murphy

(57) ABSTRACT

Free-flowing, storage-stable homogeneous granules for protecting silver in machine dishwashing are obtained through a granular free-flowing component comprising an organic solid (I) from the group of alkylaminotriazoles and a constituent (II) selected from the group of alkali metal sulfates, the ratio of solid (I) to solid (II) being from 1:100 to 2:1, preferably from 1:70 to 3:2 and more preferably from 1:50 to 2:3 and the component having a particle size of 0.01 to 2 millimeters, preferably 0.05 to 1.8 millimeters and more preferably 0.1 to 1.6 millimeters.

15 Claims, No Drawings

OTHER PUBLICATIONS

Derwent Patent Abstract (WPAT) No. 96–011551/02 (Nov. 1995).
Derwent Patent Abstract (WPAT) No. 97–481903/45 (Oct. 1997).
Derwent Patent Abstract (WPAT) No. 76–66840X/36 (Oct. 1976).
Derwent Patent Abstract (WPAT) No. 95–006760/01 (Feb. 1995).
Derwent Patent Abstract (WPAT) No. 93–077559/10 (Mar. 1993).
Derwent Patent Abstract (WPAT) No. 95–006761/01 (May 1995).

* cited by examiner

GRANULAR COMPONENT CONTAINING ALKYLAMINOTRIAZOLE FOR USE IN MACHINE DISHWASHING DETERGENTS

CROSS-REFERENCE TO RELATED APPLICATIONS

This application claims priority of copending German application 197 58 262.1, filed Dec. 31, 1997, the disclosure of which is hereby incorporated by reference.

BACKGROUND OF THE INVENTION

This invention relates to granular components containing alkylaminotriazole for use in machine dishwashing detergents and to a process for its production.

Granular machine dishwashing detergents are well known because they are easy to measure out, pourable and free-flowing, stable in storage and visually attractive to the consumer.

Alkylaminotriazole is a corrosion-inhibiting component which is now widely used in detergents containing available oxygen. Unfortunately, its chemical stability in such systems is limited because alkylaminotriazole is degraded by alkaline substances. As a result, yellow-colored and pungent-smelling oxidation products are formed, above all in the event of prolonged storage, leading to discoloration of the detergent, to a loss of the corrosion-inhibiting effect and to inadequate acceptance of the product by the consumer.

GB 1,400,444 (Unilever) describes granules which contain a uniformly dispersed organic extrudable solid selected from the group of corrosion inhibitors, such as benzotriazoles, bismethylene benzotriazoles, ethoxylated phosphate esters, oximes and hydroxamates and which are suitable for incorporation in detergent powder compositions. An important feature of these granules is that the extrudable solid is selected so that the granules dissolve in water at 20° C. in less than 10 minutes and preferably in 2 minutes. The described document claims all "suitable" processes which work on the mixture of the organic extrudable solid, including for example grinding, pelleting, extrusion, compaction and pressing. The document points out that, through the use of organic solids, there is generally no segregation of various particles in detergents containing the granules according to the invention.

WO 9511416 (Procter & Gamble) describes a bleaching composition suitable for machine dishwashing which contains an oxygen bleaching agent, paraffin oil and a benzotriazole component, the component as a whole being intended for use in detergents. The components may be present as powders, granules, pastes, liquids, gels, tablets, granular preparations being preferred. Densities of at least 650 g/l or, normally, of at least 700 g/l and preferably in the range from 800 to 1200 g/l and particle sizes distributed so that no more than 5% of the particles are larger than 1.4 mm in diameter and no more than 5% of the particles are smaller than 0.15 mm in diameter are preferred. The document in question describes several processes for obtaining these granules. One preferred process for the production of the compound comprises premixing paraffin oil and a dispersant, the resulting premix being sprayed onto the rest of the composition. The dispersant is advantageously a nonionic surfactant. However, another preferred process known as coating comprises spraying paraffin oil and dispersant onto the bleaching agent which reduces the dissolving rate of the bleaching agent in water. The coated bleaching particles are then dry-blended with the rest of the composition. The document in question also describes compacting of the bleaching agent before it is dry-blended with the remaining ingredients of the composition. However, it does not show how alkylaminotriazole is supposed to be uniformly incorporated in a free-flowing component of a dishwashing detergent.

U.S. Pat. No. 4,321,166 (Procter & Gamble) describes builder-free liquid detergent systems which contain a mixture of aromatic triazoles and oligomeric olefinic fatty acids as corrosion inhibitor. The corrosion inhibitor is said to prevent discoloration of the metal basket in automatic washing machines and the discoloration of fibers which come into contact with that basket. The document in question does not show how organic redox-active substances can be uniformly incorporated in bleaching components or how silver can be protected by these components.

Hitherto unpublished DE 196 31 787 describes a process for the production of a granular free-flowing component which comprises a solid (I) melting above 50° C. from the group of organic redox-active substances, preferably from the group of benzotriazoles, and a constituent (II) solid at its melting temperature selected from the group of builder components typically encountered in dishwashing detergents and one or more other constituents from the group of hydrocarbon carbons or mixtures thereof and one or more other constituents from the group of polar organic solvents and surfactants, the ratio of solid (I) to solid (II) being from 1:100 to 2:1, preferably from 1:70 to 3:2 and more preferably from 1:50 to 2:3 and the component having a particle size of 0.01 to 2 millimeters, preferably from 0.05 to 1.8 millimeters and more preferably from 0.1 to 1.6 millimeters.

Hitherto unpublished DE 197 01 031 describes the use of alkylaminotriazoles as silver protectors in machine dishwashing detergents.

However, none of the patent specifications cited above shows how a granular free-flowing component containing alkylaminotriazole can be produced. The problem lies inter alia in the fact that mixtures containing alkylaminotriazole which are conventionally produced by granulation, for example using granulation liquids, are difficult to process because the mixture tends to cake and, as a result, does not flow freely. The component should retain its physical property of free flowability over a prolonged period. However, the problem of the chemical stability of components containing alkylaminotriazole also cannot be solved by the teachings of the documents cited above. This property becomes all the more important against the background of the incorporation of these components in machine dishwashing detergents. Here, the properties of physical and chemical stability of the granular components are particularly desirable. Alkylaminotriazole should remain stable in the presence of oxidative and alkaline components so that it can still act as a silver protector. Another serious problem is that, in its production process, alkylaminotriazole is obtained in the form of a solution in hydrochloric acid. If a formulation such as this is applied to an alkaline support, the alkylaminotriazole decomposes immediately.

The problem addressed by the present invention was to provide free-flowing, storage-stable homogeneous granules containing alkylaminotriazole which would be suitable for protecting silver in machine dishwashing. The alkylaminotriazole present in the granules would be protected against oxidative attack.

DESCRIPTION OF THE INVENTION

The present invention relates to a granular free-flowing component comprising an organic solid (I) from the group of alkylaminotriazoles and a constituent (II) selected from the group of alkali metal sulfates, the ratio of solid (I) to solid (II) being from 1:100 to 2:1, preferably from 1:70 to 3:2 and more preferably from 1:50 to 2:3 and the component having a particle size of 0.01 to 2 millimeters, preferably in the range from 0.05 to 1.8 millimeters and more preferably in the range from 0.1 to 1.6 millimeters.

The granular components according to the invention contain from 0.001 % by weight to 33% by weight, preferably from 0.05 to 20% by weight and more preferably from 0.5 to 10% by weight of alkylaminotriazole compounds. Alkylaminotriazole compounds are known among experts to be any chemical derivatives of the alkylaminotriazole skeleton. Derivatives of alkylaminotriazole in the context of the present invention are above all the completely or partly substituted compounds, suitable substituents being linear or branched alkyl chains containing 1 to 20 carbon atoms. However, OH, SH or vinyl groups or halogen atoms are also suitable.

According to the invention, preferred components are those in which the ratio of solid (I) to solid (II) is from 1:100 to 2:1, preferably from 1:70 to 3:2 and more preferably from 1:50 to 2:3.

An important parameter for the granular components according to the invention is their particle size which should be from 0.01 to 2 millimeters, preferably from 0.05 to 1.8 millimeters and more preferably from 0.1 to 1.6 millimeters.

According to the invention, alkylaminotriazoles are understood in particular to be 3-amino-5-alkyl-1,2,4-triazoles corresponding to general formula (I):

(I)

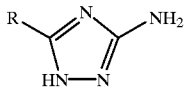

in which R is a linear or branched, saturated or unsaturated, optionally hydroxy- or alkoxyl-substituted alkyl group containing 1 to 15 carbon atoms or an aryl, furyl, tetrahydrofuryl, thienyl, pyridyl, pyrrolidinyl, 5-oxo-2-pyrrolidinyl, pyrryl, imidazolyl or pyrimidyl group optionally substituted by hydroxy groups, primary, secondary or tertiary amino groups, alkoxy, alkylthio or thiol groups, and salts thereof with mineral acids, such as carbonic acid or organic carboxylic. acid. The following are examples of the 3-amino-5-alkyl-1,2,4-triazoles suitable for use in accordance with the invention: 5-propyl-, -butyl-, -pentyl-, -heptyl-, -octyl-, -nonyl-, -decyl-, -undecyl-, -dodecyl-, -isononyl-, -versatic-10-acid alkyl-, -phenyl-, -p-tolyl-, -(4-tert.butylphenyl)-, -(4-methoxyphenyl)-, -(2-, -3-, 4-pyridyl)-,-(2-thienyl)-, -5-(methyl-2-furyl)-, -5-(oxo-2-pyrrolidinyl)-, -3-amino-1,2,4-triazole.

Preferred acids for salt formation are hydrochloric acid, sulfuric acid, phosphoric acid; carbonic acid; sulfurous acid; organic carboxylic acids, such as acetic acid, glycolic acid, citric acid, succinic acid.

The present invention also relates to the use of this granular free-flowing component as a silver protector in machine dishwashing detergents.

The present invention also relates to a process for the production of granular free-flowing components which is characterized in that the solid (I) is sprayed-in liquid -form,-for example -in the form of a-solution in hydrochloric acid, onto the solid (II), optionally at elevated temperature.

The process according to the invention may be carried out continuously or as a batch process. The coarse-particle solid (I) is sprayed briefly, preferably for 1 to 5 minutes and more preferably for 3 minutes, with the organic solid (II) in liquid form in a commercially available mixer, preferably a plowshare mixer, with minimal input of energy and in a way which minimizes abrasion of the particles,.for example without the use of a circular blade, and is then optionally cooled or even left to cool. In addition, other steps typically applied in the granulation of detergents, for example coating, impregnation, addition of flow promoters, drying, extrusion and the like, may be carried out to adjust the properties of the powder. The addition of flow promoters is particularly appropriate.

A melt of the organic solid (I) may be used in this process. In one preferred embodiment of the invention, however, the solid (I) is used in the form of a solution in hydrochloric acid, preferably in concentrations of more than 30% by weight and more preferably in concentrations of 40% by weight. However, another solvent (III) may also be used. This solvent (III) is preferably selected from the group consisting of methanol, ethanol, isopropanol, ethylene glycol, propylene glycol, acetone, methylethyl ketone, polyethylene glycols and polypropylene glycols.

However, other preferred solvents are surfactants, nonionic surfactants being particularly preferred. Surfactants from the group of alkyl polyglycosides, fatty alcohol ethoxylates or propoxylates and esters thereof are most particularly preferred for the purposes of the invention.

The decomposition of the alkylaminotriazole can be prevented by the use of commercially available alkali metal sulfate. However, a problem in this regard is that, in some cases, the mixture can accumulate in the form of very fine particles with poor flow properties. If the compound obtained is then compacted, for example in a roll compactor, free flowing coarse granules of high bulk density are obtained. The granular structure of the compound considerably improves the storage stability of the alkylaminotriazole in alkaline detergents. It also reduces the tendency to separate in powder formulations.

In certain cases, a final step in which the granular components produced by the process described above are sprayed at elevated temperature with hydrocarbons or with a mixture of hydrocarbons having a melting point of 30° C. to 120° C., preferably in the range from 30° C. to 80° C. and more preferably in the range from 45° C. to 65° C. has a positive effect. Above all, macrocrystalline paraffins with melting points of 40° C. to 60° C., microcrystalline paraffins with melting points of 60° C. to 75° C. and mixtures of macrocrystalline and microcrystalline paraffins with melting points of, for example, 45° C. to 65° C. are preferably used for the purposes of the invention. However, other hydrocarbons and mixtures of hydrocarbons may also be used.

The granular component may even be colored which can be of considerable advantage in certain embodiments. In this case, the dye is preferably applied to the solid (II) in a solvent, although it has also proved effective in some cases to color a solution of the solid (I).

After a possible cooling step, another solid (IV) from the group of builders may be added, which results in the formation of a free-flowing granular component which is easy to incorporate in dishwashing detergents and which gives storage-stable detergents that provide effective protection of silver. In addition, other steps typically applied in the granulation of detergents, for example coating, impregnation, addition of flow promoters, drying, extrusion and the like, may be carried out to adjust the powder properties.

The present invention also relates to a dishwashing detergent containing a granular component, preferably in quantities of 1 to 40% by weight, based on the mixture as a whole, the dishwashing detergent containing other components typically encountered in dishwashing detergents, such as builders, bleaching agents, surfactants, corrosion inhibitors, polymers, other silver protectors, soil release compounds, defoamers, perfumes and fragrances and the like.

Water-soluble and water-insoluble builders may be used in the detergents according to the invention, above all to bind calcium and magnesium. Water-soluble builders are preferred because they generally have a lesser tendency to form insoluble residues on dishes and hard surfaces. Typical builders which may be present in accordance with the invention in quantities of 10 to 90% by weight, based on the preparation as a whole, are low molecular weight polycarboxylic acids and salts thereof, homopolymeric and copolymeric polycarboxylic acids and salts thereof, carbonates, phosphates and silicates. Water-insoluble builders include zeolites, which may also be used, and mixtures of the builders mentioned above. Trisodium citrate and/or pentasodium tripolyphosphate and silicate builders from the class of disilicates are preferably used for the detergents according to the invention.

Alkali carriers may be present as further constituents. Alkali carriers are alkali metal hydroxides, alkali metal carbonates, alkali metal hydrogen carbonates, alkali metal sesquicarbonates, alkali metal silicates, alkali metal metasilicates and mixtures of the above-mentioned substances. Alkali metal carbonates, more particularly sodium carbonate, sodium hydrogen carbonate or sodium sesquicarbonate, are preferably used for the purposes of the invention.

Bleach activators which are preferably used in accordance with the invention are compounds which contain one or more N-acyl or O-acyl groups, such as substances from the class of anhydrides, esters, imides and acylated imidazoles or oximes. Examples are tetraacetyl ethylenediamine (TAED), tetraacetyl methylenediamine (TAMD) and tetraacetyl hexylenediamine (TAHD) and also pentaacetyl glucose (PAG), 1,5-diacetyl-2,2-dioxohexahydro-1,3,5-triazine (DADHT) and isatoic anhydride (ISA).

The bleach activators may be compounds which form aliphatic peroxocarboxylic acids containing preferably 1 to 10 carbon atoms and more preferably 2 to 4 carbon atoms and/or optionally substituted perbenzoic acid under perhydrolysis conditions. Compounds bearing O- and/or N-acyl groups with the number of carbon atoms mentioned and/or optionally substituted benzoyl groups are suitable. Preferred bleach activators are polyacylated alkylenediamines, more particularly tetraacetyl ethylenediamine (TAED), acylated triazine derivatives, more particularly 1,5-diacetyl-2,4-dioxohexahydro-1,3,5-triazine (DADHT), acylated glycolurils, more particularly tetraacetyl glycoluril (TAGU), N-acylimides, more particularly N-nonanoyl succinimide (NOSI), acylated phenol sulfonates, more particularly n-nonanoyl or isononanoyloxybenzenesulfonate (n- or iso-NOBS), carboxylic anhydrides, more particularly phthalic anhydride, acylated polyhydric alcohols, more particularly triacetin, ethylene glycol diacetate, 2,5-diacetoxy-2,5-dihydrofuran, n-methyl morpholinium acetonitrile methyl sulfate (MMA) and the enol esters known from German patent applications DE 196 16 693 and DE 196 16 767, acetylated sorbitol and mannitol and the mixtures thereof (SORMAN) described in European patent application EP 0 525 239, acylated sugar derivatives, more particularly pentaacetyl glucose (PAG), pentaacetyl fructose, tetraacetyl xylose and octaacetyl lactose, and acetylated, optionally N-alkylated glucamine and gluconolactone, and/or N-acylated lactams, for example N-benzoyl caprolactam, which are known from International patent applications WO 94/27970, WO 94128102, WO 94128103, WO 95/00626, WO 95114759 and WO 95117498. The substituted hydrophilic acyl acetals known from German patent application DE 196 16 769 and the acyl lactams described in German patent application DE 196 16 770 and in International patent application WO 95/14075 are also preferably used. The combinations of conventional bleach activators known from German patent application DE 44 43 177 may also be used. Bleach activators such as these are present in the usual quantities, preferably in quantities of 1% by weight to 10% by weight and more preferably in quantities of 2% by weight to 8% by weight, based on the detergent as a whole.

In addition to or instead of the conventional bleach activators mentioned above, the sulfonimines known from European patents EP 0 446 982 and EP 0 453 003 and/or bleach-boosting transition metal salts or transition metal complexes may also be present as so-called bleach catalysts. Suitable transition metal compounds include, in particular, the manganese, iron-, cobalt-, ruthenium- or molybdenum-salen complexes known from German patent application DE 195 29 905 and the N-analog compounds thereof known from German patent application DE 196 20 267, the manganese-, iron-, cobalt-, ruthenium- or molybdenum-carbonyl complexes known from German patent application DE 195 36 082, the manganese, iron, cobalt, ruthenium, molybdenum, titanium, vanadium and copper complexes with nitrogen-containing tripod ligands described in German patent application DE 196 05 688, the cobalt-, iron-, copper- and ruthenium-ammine complexes known from German patent application DE 196 20 411, the manganese, copper and cobalt complexes described in German patent application DE 44 16 438, the cobalt complexes described in European patent application EP 0 272 030, the manganese complexes known from European patent application EP 0 693 550, the manganese, iron, cobalt and copper complexes known from European patent EP 0 392 592 and/or the manganese complexes described in European patent EP 0 443 651 or in European patent applications EP 0 458 397, EP 0 458 398, EP 0 549 271, EP 0 549 272, EP 0 544 490 and EP 0 544 519. Combinations of bleach activators and transition metal bleach catalysts are known, for example, from German patent application DE 196 13 103 and from international patent application WO 95127775. Preferred bleach activators are those from the group of polyacylated alkylenediamines, more particularly tetraacetyl ethylenediamine (TAED), N-acylimides, more especially N-nonanoyl succinimide (NOSI), acylated phenol sulfonates, more especially n-nonanoyl or isononanoyl oxybenzenesulfonate (n- or iso-NOBS), MMA, which are used in quantities of up to 10% by weight, preferably in quantities of 0.1% by weight to 8% by weight, more preferably in quantities of 2 to 8% by weight and most preferably in quantities of 2 to 6% by weight, based on the detergent as a whole.

Bleach-boosting transition metal complexes, more particularly with the central atoms Mn, Fe, Co. Cu, Mo. V, Ti and/or Ru, preferably selected from the group of manganese and/or cobalt salts and/or complexes, more preferably cobalt (ammine) complexes, cobalt(acetate) complexes, cobalt (carbonyl) complexes, chlorides of cobalt or manganese, manganese sulfate, are used in typical quantities, preferably in a quantity of up to 5% by weight, more preferably in a quantity of 0.0025% by weight to 1% by weight and most preferably in a quantity of 0.01% by weight to 0.25% by weight, based on the detergent as a whole. However, more bleach activator may also be used in special cases.

Soil-release compounds may also be introduced with advantage into the dishwashing detergents according to the invention. The soil-release compounds used in accordance with the invention include all the compounds known from the prior art. Particularly suitable soil-release compounds are the cationic polymers known, for example, from the following documents:

According to EP-A-0 167 382, EP-A-0 342 997 and DE-OS 26 16 404, cationic polymers are added to detergents to achieve streak-free cleaning of the surfaces.

EP-A-0 167 382 describes liquid detergent compositions which may contain cationic polymers as thickeners. Particularly suitable cationic polymers are said to include hydroxypropyl trimethylammonium guar; copolymers of aminoethyl methacrylate and acrylamide and copolymers of dimethyl diallylammonium chloride and acrylamide.

EP-A-0 342 997 describes all-purpose cleaners which may contain cationic polymers, more especially polymers containing imino groups.

DE-OS 26 16 404 describes glass cleaners containing cationic cellulose derivatives. The addition of the cationic cellulose derivatives to the cleaners ensures better drainage of the water so that streak-free glass surfaces are obtained.

EP-A0 467 472 describes, for example, cleaners for hard surfaces which contain cationic homopolymers and/or copolymers as soil-release polymers. These polymers contain quaternized ammonium alkyl methacrylate groups as monomer units. These compounds are used to finish the surfaces in such a way that, the next time they are cleaned, the various soil types are easier to remove.

Particularly preferred soil release compounds are cationic polymers selected from cationic polymers of copolymers of monomers, such as trialkylammonium alkyl (meth)acrylate or acrylamide; dialkyl diallyl diammonium salts; polymer-analog reaction products of ethers or esters of polysaccharides with ammonium side groups, more particularly guar, cellulose and starch derivatives; polyadducts of ethylene oxide containing ammonium groups; quaternary ethyleneimine polymers and polyesters and polyamides containing quaternary side groups.

According to the invention, enzymes may be added to the detergent in quantities of 0 to 5% by weight, based on the detergent as a whole, in order to enhance the performance of the detergents or to guarantee the same cleaning performance under milder conditions. The most commonly used enzymes include lipases, amylases, cellulases and proteases. Preferred proteases are, for example, BLAP® 140 (Biozym), Optimase® M440 and Opticlean® M-250 (Solvay Enzymes); Maxacal® CX and Maxapem® or Esperase® (Gist Brocades) or even Savinase® (Novo). Particularly suitable cellulases and lipases are Celluzym® 0,7 T and Lipolase® 30 T (Novo Nordisk). Particularly suitable amylases are Termamyl® 60 T, Termamyl® 90 T and Duramyl® (NOVO), Amylase-LT® (Solvay Enzymes) and Maxamyl® P5000 (Gist Brocades), although other enzymes may also be used.

Surfactants may also be added to the dishwashing detergent according to the invention, nonionic surfactants, such as alkyl polyglycosides, ethoxylated fatty alcohols and glucamides, being particularly preferred.

Alkyl polyglycosides are surfactants which may be obtained by reacting sugars and alcohols using the relevant methods of preparative organic chemistry, a mixture of monoalkylated, oligomeric or polymeric sugars being obtained according to the production process used. Preferred alkyl polyglycosides are alkyl polyglucosides. In a particularly preferred embodiment, the alcohol is a long-chain fatty alcohol or a mixture of long-chain fatty alcohols and the degree of oligomerization of the sugars is between 1 and 10. Alkoxylated alcohols are generally understood among experts to be the reaction products of alkylene oxide, preferably ethylene oxide, with alcohols, relatively long-chain alcohols being preferred for the purposes of the invention. In general, a complex mixture of addition products differing in their degrees of ethoxylation is formed from n moles of ethylene oxide and 1 mole of alcohol, depending on the reaction conditions. Another embodiment comprises using mixtures of alkylene oxides, preferably a mixture of ethylene oxide and propylene oxide. If desired, substances belonging to the class of "end-capped" alcohol ethoxylates, which may also be used in accordance with the invention, may also be obtained by a concluding etherification step using short-chain alkyl groups, preferably butyl groups. Highly ethoxylated fatty alcohols or mixtures thereof with end-capped fatty alcohol ethoxylates are most particularly preferred for the purposes of the invention.

Fatty acid polyhydroxylamides (glucamides) are acylated reaction products of the reductive amination of a sugar (glucose) with ammonia, long-chain fatty acids, long-chain fatty acid esters or long-chain fatty acid chlorides generally being used as the acylating agent. Secondary amides are formed if methylamine or ethylamine is used instead of ammonia for the reduction process, as described for example in SÖFW-Journal, 119, (1993), 794–808. Carbon chain lengths of $C_6$ to $C_{12}$ are preferably used in the fatty acid component.

Dishwashing detergents according to the invention may contain other corrosion inhibitors to protect the machine load or the machine itself. The silver protectors described, for example, in DE 43 25 992, in DE 41 28 672 or in DE 43 38 724 are particularly important in machine dishwashing. In addition, detergent formulations often contain active chlorine sources which can distinctly reduce corrosion of silver surfaces. According to the documents cited above, oxygen- and--nitrogen-containing organic redox-active compounds, such as dihydric and trihydric phenols, for example hydroquinone, pyrocatechol, hydroxyhydroquinone, gallic acid, phloroglucinol, pyrogallol and derivatives of these compounds, are particularly suitable for chlorine-free detergents. Salt-like and complex-like inorganic compounds such as salts of the metals Mn, Ti, Zr, Hf, V, Co and Ce, are often used. Zinc compounds may also be used to prevent corrosion of the machine load.

The dishwashing detergents according to the invention may be produced in any of the forms known from the prior art, including powders, granules, suspensions and moldings, such as pellets, extrudates and, above all, moldings. The moldings may assume any three-dimensional forms as listed inter alia in prior art patent specifications and standard works of the specialist literature (cf., for example, Riedel "Die Tablette").

These include, in particular, cylindrical tablets, preferably with a diameter of 15 to 60 mm and, more particularly, 30±10 mm. The height of the tablets is preferably from 5 to 30 mm and more preferably from 15 to 28 mm. Moldings with diameters of 32, 33, 34, 35, 36, 37, 38 and 39 mm have proved to be particularly favorable. In special embodiments, the height is 24, 25, 26, 27 or 28 mm.

However, square, rectangular, trapezoidal, oval and irregularly shaped basal surfaces may also be used. The edge lengths are preferably from 15 to 60 mm and, more particularly, 30±10 mm.

The weight of the individual moldings, particularly the tablets, is preferably from 15 to 60 g and more preferably from 20 to 40 g per molding or tablet. By contrast, the density of the moldings or tablets is normally above 1 kg/dm$^3$ and preferably between 1.1 and 1.4 kg/dm$^3$.

One or more moldings, for example 2 to 4 moldings, especially tablets, may be used according to the particular application, the water hardness or the degree of soiling. Other moldings according to the invention may even have smaller diameters or dimensions, for example of the order of 10 mm.

The moldings of the dishwashing detergent may be homogeneous or heterogeneous. In one simple case, heterogeneous moldings may be produced, for example, by giving the various ingredients different colors and/or different perfume components.

Another case which may be included in accordance with the invention among the heterogeneous moldings is an embodiment in which a molding containing several layers (phases) i.e. at least two layers, is produced. It is possible, for example, for these various layers to have different disintegration and dissolving rates and/or to contain different ingredients. This can lead to advantageous performance properties of the moldings. If, for example, the moldings contain ingredients which adversely affect one another, they can be separated. If a specific sequence of cleaning conditions is to be established in one and the same machine, one (or more) component(s) may be integrated in a (or the) more rapidly disintegrating and/or more rapidly dissolving layer and the other component(s) may be incorporated in a (or the) more slowly disintegrating layer, so that one component can act with delay or can have already reacted off by the time another component dissolves.

A preferred embodiment of the invention is characterized in that two phases are present. In a particularly favorable version of this embodiment, the ratios by volume of the two phases are from 10:1 to 1:10, preferably from 5:1 to 1:5 and more preferably from 2:1 to 1:2.

Another particularly preferred embodiment is characterized in that three or more other phases are present.

Another preferred form is a molding in which a regularly or irregularly shaped region is present in addition to one, two or three phases and occupies no more than 30% by volume of the molding. This region is preferably a depression.

EXAMPLES

Production of the Component According to the Invention 27.9 kg of sodium sulfate were introduced into a Lödige plowshare mixer and, without using the circular blade, were sprayed for 3 minutes with 2.1 kg of alkylaminotriazole (in the form of a 40% by weight solution in hydrochloric acid), a granular component being formed after cooling to room temperature.

The product was then compacted into granules in a standard roll compactor.

Quantities of up to 6% by weight of this granular component, based on the detergent as a whole, were mixed with other ingredients in one or more following mixing steps to form a machine dishwashing detergent. The detergent consisted, for example, of 25 g of sodium citrate, 25 g of sodium carbonate, 10 g of sodium perforate, 4 g of tetraethylenediamine tetraacetic acid, 3.5 g of enzymes (such as amylase, protease and lipase) and 2 g of nonionic surfactants (such as alkyl polyglycosides and ethoxylated fatty alcohols).

The components according to the invention may readily be incorporated in dishwashing detergents and give storage-stable detergents guaranteeing effective protection of silver. The compositions of the granules used are shown in Table (I):

| Ingredients | I | II | III | IV | V | VI | VII |
|---|---|---|---|---|---|---|---|
| Alkylaminotriazole | 7 | 7 | 5 | 5 | 5 | 10 | 4.5 |
| Sodium sulfate | 93 | 83 | 82 | 82 | 82 | 73 | 85 |
| Surfactant | — | — | 5 | — | 2.5 | 7 | — |
| Polyethylene glycol | — | — | — | 5 | 2.5 | — | 6.5 |
| Paraffin | — | 10 | 8 | 8 | 8 | 10 | 4 |

Surfactants: for example Dehydol® LS4 (nonionic surfactant: cocoalcohol 4EO), Dehypon® LS54 (nonionic surfactant: cocoalcohol 5EO 4PO), Plurafac® LF 403 ($C_{11-13}$ nonionic surfactant, 4EO 3PO)

Polyethylene glycols: various molecular weights, for example 1500, were used. Paraffins: macrocrystalline paraffins with melting points of 40° C. to 60° C. and microcrystalline paraffins with melting points of 60° C. to 75° C. and mixtures of macrocrystalline and microcrystalline paraffins with melting points of 45° C. to 65° C. were preferably used.

Components I to VII had a particle size of 0.1 to 1.6 millimeters.

Components I to VII were mixed with percarbonate/TAED or perborate/TAED and typical detergent ingredients (citrate/phosphate, alkali carriers, enzymes). The powder mixture was spread out over crystallizing dishes and stored in the open for 4 days at 30° C./80% relative air humidity. If oxidative processes and decomposition of the alkylaminotriazole occur, the powder turns yellow in color and has an unpleasant odor of garlic or almond oil.

The mixtures were visually and olfactorily evaluated by several experts on the subject of machine dishwashing. The results of the storage test are set out in Table (II).

| Ingredients | I | II | III | IV | V | VI | VII |
|---|---|---|---|---|---|---|---|
| Oxidative yellowing | Slight | Slight | None | None | None | None | None |
| Oxidative change of odor | Slight | Slight | None | None | None | None | None |
| Acceptable in accordance with the invention | Yes | Yes | Yes | Yes | Yes | Yes | Yes |

Other possible basic formulations which may be used are shown in the following. Possible basic formulation (R) and test formulations (V) (figures=% by weight)

| Ingredient | Ra | Va1 |
|---|---|---|
| Phosphate (sodium tripolyphosphate) | 30–60 | 54.8 |
| Sodium carbonate | 5–25 | 15.9 |
| Sodium disilicate | 0–40 | 7.3 |
| Polymer (Sokalan CP5) | 0–10 | 2.2 |
| Sodium metasilicate | 0–10 | |
| Sodium hydrogen carbonate | 0–10 | |
| Bleach (sodium perborate) | 2–20 | 9.0 |
| Bleach activator (TAED) (co-pentammine-Cl) | 0–5 | 2.1 |
| Enzyme (amylase, Duramyl 60 T) | 0–5 | 2.0 |
| Enzyme (protease, Blap 200 S) | 0–5 | 1.8 |
| Phosphonate or phosphonic acid | 0–5 | 0.9 |
| Nonionic surfactant (Dehypon LS 54) | 0–5 | 2.0 |
| Silver protector (alkylaminotriazole) | 0–10 | 0.3 |
| Tabletting aid (polyethylene glycol) | 0–10 | |

-continued

| Ingredient | Ra | Va1 |
|---|---|---|
| Paraffin (Mp.: 53° C.) | 0–10 | |
| Perfume | 0–1 | 0.2 |
| Dye | 0.4 | 1.4 |

The builder system of the above basic formulation may also have the following composition (all other ingredients same as for a)

| Ingredient | Rb | Vb1 | Vb2 | Vb3 | Vb4 | Vb5 | Vb6 | Vb7 |
|---|---|---|---|---|---|---|---|---|
| Phosphate (sodium tripoly-phosphate) | 30–60 | 59 | 56 | 53 | 48 | 48 | 48 | 47 |
| Carbonate (sodium carbonate) | 5–25 | 21.2 | 20.3 | 22.7 | 17 | 20 | 16 | 24 |
| Polymer (Sokalan CP5) | 0–10 | | 2 | 10 | 5 | 4 | | 5 |
| Sodium metasilicate | 0–10 | | | 1.8 | | | | |
| Sodium hydrogen carbonate | 0–10 | | | | 1 | | 3 | |

Another basic formulation (R) according to the invention is shown in the following Table (figures=% by weight)

| Ingredient | Rc | Vc1 | Vc2 |
|---|---|---|---|
| Phosphate (sodium tripolyphosphate) | 15–35 | 30 | 35 |
| Carbonate (sodium carbonate) | 25–55 | 39 | 40 |
| Sodium hydrogen carbonate | 10–20 | 14 | 15 |
| Polymer (Sokalan CP5) | 0–10 | 3 | |
| Sodium disilicate | 0–10 | | |
| Sodium disilicate | 0–10 | 0 | 0 |
| Bleach (sodium perborate) | 2–10 | 7 | 5 |
| Bleach activator (TAED) | 0–5 | 1 | 1 |
| Enzyme (amylase, Duramyl 60 T) | 0.4–2 | 1 | 0.5 |
| Enzyme (protease, Blap 200 S) | 0.4–2 | 1 | 0.5 |
| Phosphonate or phosphonic acid | 0–5 | 0 | 0 |
| Nonionic surfactant (Dehypon LS 54) | 0–5 | 2 | 1 |
| Silver protector (alkylaminotriazole) | 0–10 | 0.5 | 0.3 |
| Paraffin (Mp.: 53° C.) | 0–10 | 0 | |
| Perfume | 0–1 | 0 | 0.7 |
| Dye | 0–4 | 0.5 | 1 |

Another basic formulation (R) according to the invention is shown in the following Table (figures=% by weight):

| Ingredient | Rd | Vd1 | Vd2 |
|---|---|---|---|
| Trisodium citrate | 20–55 | 44 | 34 |
| Sodium hydrogen carbonate | 5–35 | 24 | 9 |
| Carbonate (sodium carbonate) | 0–10 | 7 | |
| Polymer (Sokalan CP5) | 0–10 | | 6 |
| Sodium disilicate | 0–25 | | 20 |
| Bleach (sodium perborate) | 0–22 | 9 | 16 |
| Bleach activator (TAED) | 0–25 | 3 | 1 |
| Enzyme (amylase, Duramyl 60 T) | 0.4–5 | 2.5 | 3 |
| Enzyme (protease, Blap 200 S) | 0.4–5 | 2 | 3 |
| Phosphonate or phosphonic acid | 0–5 | 1.5 | 2.3 |
| Nonionic surfactant (Dehypon (LS 54) | 0–5 | 2.5 | 1.7 |
| Silver protector (alkylaminotriazole) | 0–10 | 0.5 | 0.5 |
| Paraffin (Mp.: 53° C.) | 0–10 | 3 | 1.5 |
| Perfume | 0–1 | 0.9 | 0.5 |
| Dye | 0–4 | 0.1 | 1.5 |

Another basic formulation (R) according to the invention is shown in the following Table (figures=% by weight):

| Ingredient | Re | Ve1 | Ve2 |
|---|---|---|---|
| Citrate (trisodium citrate) | 20–55 | 38 | 24 |
| Phosphate (trisodium polyphosphate) | 20–55 | 24 | 24 |
| Carbonate (sodium carbonate) | 1–15 | 11 | 15 |
| Polymer (Sokalan CP5) | 0–10 | 1.5 | 6 |
| Silicate (sodium disilicate) | 0–25 | | 6 |
| Bleach (sodium perborate) | 2–20 | 12 | 9 |
| Bleach activator (TAED) | 0–5 | 2 | 3 |

-continued

| Ingredient | Re | Ve1 | Ve2 |
|---|---|---|---|
| Enzyme (amylase, Duramyl 60 T) | 0–5 | 3 | 2 |
| Enzyme (protease, Blap 200 S) | 0–5 | 0.5 | 2 |
| Phosphonate or phosphonic acid | 0–5 | | 2 |
| Tabletting aid (polyethylene glycol) | 0–10 | 5 | 0.8 |
| Nonionic surfactant (Dehypon LS 54) | 0–5 | 2.8 | 2 |
| Silver protector (alkylaminotriazole) | 0–10 | 0.2 | 0.2 |
| Paraffin (Mp.: 53° C.) | 0–10 | | |
| Perfume | 0–1 | | 1 |
| Dye | 0–4 | | 1 |

Another basic formulation (R) according to the invention is shown in the following Table (figures=% by weight)

| Ingredient | Rf | Vf1 | Vf2 | Vf3 | Vf4 |
|---|---|---|---|---|---|
| Phosphate (trisodium polyphosphate) | 40–60 | 49 | 49 | 49 | 50 |
| Carbonate (sodium carbonate | 0–20 | | 17 | 19 | 5 |
| Polymer (Sokalan CP5) | 0–15 | 2 | 4 | 1 | 6 |
| Silicate (sodium disilicate) | 0–30 | 24 | 6 | 5 | 10 |
| Bleach (sodium perborate) | 0–15 | 10 | 8 | 10 | 8 |
| Bleach activator (TAED) | 0–5 | 15 | 2 | 3 | 2 |
| Enzyme (amylase, Duramyl 60 T) | 0–5 | 2 | 2 | 1.5 | 2.5 |
| Enzyme (protease, Blap 200 S) | 0–5 | 3.9 | 2 | 1.5 | 2.5 |
| Phosphonate or phosphonic acid | 0–8 | 0.8 | 1 | 1 | 2 |
| Tabletting aid (polyethylene glycol) | 0–10 | 0.2 | 4 | 3.7 | 5 |
| Nonionic surfactant (Dehypon LS 54) | 0–8 | 1.5 | 2 | 4 | 3 |
| Silver protector (alkylaminotriazole) | 0–10 | 0.1 | 0.5 | 0.3 | 0.5 |
| Perfume | 0–2 | 1 | 0.5 | 0.5 | 0.5 |
| Dye | 0–4 | 3 | 2 | 0.5 | 1 |

Another basic formulation (R) according to the invention is shown in the following Table (figures=% by weight)

| Ingredient | Rg | Vg1 | Vg2 | Vg3 |
|---|---|---|---|---|
| Phosphate (trisodium polyphosphate) | 30–60 | 55.7 | 59.6 | 47 |
| Sodium disilicate | 5–40 | 22.3 | 17.5 | 24 |
| Polymer (Sokalan CP5) | 0–10 | 2.2 | 2.2 | 5 |
| Sodium metasilicate | 0–10 | | | |
| Sodium hydrogen carbonate | 0–10 | | | |
| Bleach (sodium perborate) | 2–20 | 10 | 10 | 10 |
| Bleach activator (co-catalyst) | 0–2 | 1.1 | 1.1 | 0.5 |
| Enzyme (amylase, Duramyl 60 T) | 0–5 | 2.0 | 2.0 | 2.5 |
| Enzyme (protease, Blap 200 S) | 0–5 | 1.8 | 1.8 | 2.5 |
| Phosphonate or phosphonic acid | 0–5 | 0.9 | 0.9 | 1.5 |
| Nonionic surfactant (Dehypon LS 54) | 0–5 | 2.0 | 2.0 | 1.5 |
| Silver protector (alkylaminotriazole) | 0–10 | 0.3 | 0.3 | 0.5 |
| Tabletting aid (polyethylene glycol) | 0–10 | | | |
| Paraffin (Mp.: 53° C.) | 0–10 | | 2.0 | 3 |
| Perfume | 0–1 | 0.2 | 0.2 | 0.5 |
| Dye | 0–4 | 1.4 | 1.3 | 1.5 |

Another basic formulation (R) (% by weight) and test formulations (V) were evaluated:

| Ingredient | Ri1 | Vi1 | Vi2 |
|---|---|---|---|
| Sodium carbonate | 35–44 | 43.5 | 445 |
| Sodium hydrogen carbonate | 15–35 | 15 | 25 |
| Polymer (Sokalan CP5) | 3–10 | 5 | 3 |
| Sodium metasilicate | 0–10 | 3 | 2 |
| Bleach (sodium perborate) | 5–12 | 6 | 10 |
| Bleach activator (TAED) | 0–5 | 1 | 2 |
| Enzyme (amylase, Duramyl 60 T) | 0.4–2 | 1 | 1 |
| Enzyme (protease, Blap 200 8) | 0.4–2 | 1 | 1 |
| Phosphonate or phosphonic acid | 0–5 | 0 | 2 |
| Nonionic surfactant (Dehypon LS 54) | 0–5 | 1 | 2 |
| Tabletting aid (polyethylene glycol) | 0–5 | | 3 |
| Silver protector (alkylaminotriazole) | 0–10 | 0.5 | 1 |
| Paraffin (Mp.: 53° C.) | 0–10 | 0 | 2 |
| Perfume | 0–1 | 0 | 1 |
| Dye | 0–4 | 1 | 1 |

What claimed is:

1. A solid granular free-flowing component comprising an alkylaminotriazole compound and an inorganic alkali metal sulfate in a weight ratio of 1:100 to 2:1, the component having a particle size of 0.01 to 2 millimeters.

2. A component according to claim 1, comprising an alkylaminotriazole compound and an alkali metal sulfate in a weight ratio of 1:70 to 3:2, the component having a particle size of 0.05 to 1.8 millimeters.

3. A component according to claim 2, comprising an alkylaminotriazole compound and an alkali metal sulfate in a weight ratio of 1:50 to 2:3, the component having a particle size of 0.1 to 1.6 millimeters.

4. A component according to claim 1, comprising 0.001% to 33% by weight alkylaminotriazole compound.

5. A component according to claim 4, comprising 0.05% to 20% by weight alkylaminotriazole compound.

6. A component according to claim 5, comprising 0.5% to 10% by weight alkylaminotriazole compound.

7. A granular component according to claim 1, wherein the alkylaminotriazole comprises a compound of the formula (I):

(I)

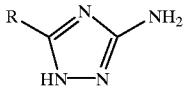

wherein R is a linear or branched, saturated or unsaturated, optionally hydroxy- or alkoxyl-substituted alkyl group containing 1 to 15 carbon atoms or an aryl, furyl, tetrahydrofuryl, thienyl, pyridyl, pyrrolidinyl, 5-oxo-2-pyrrolidinyl, pyrryl, imidazolyl or pyrimidyl group optionally substituted by hydroxy groups, primary, secondary or tertiary amino groups, alkoxy, alkylthio or thiol groups, and salts thereof.

8. A component according to claim 7, wherein R is propyl, butyl, pentyl, heptyl, octyl, nonyl, decyl, undecyl, dodecyl, isononyl, versatic-10-acid alkyl, phenyl, p-tolyl, (4-tert.butylphenyl), (4-methoxyphenyl), (2-, -3-, 4-pyridyl), (2-thienyl), 5-(methyl-2-furyl), or 5-(oxo-2-pyrrolidinyl).

9. A component according to claim 7, wherein the compound of formula (I) forms a salt with an acid selected from the group consisting of hydrochloric acid, sulfuric acid, phosphoric acid, carbonic acid, sulfurous acid, acetic acid, glycolic acid, citric acid, and succinic acid.

10. A dishwashing detergent comprising 1% to 40% by weight of the component of claim 1.

11. A dishwashing detergent comprising 1% to 40% by weight of the component of claim 4.

12. A dishwashing detergent comprising 1% to 40% by weight of the component of claim 7.

13. A solid granular free-flowing component consisting essentially of:

a. 0.001% to 33% by weight of an alkylaminotriazole compound of the formula (I):

(I)

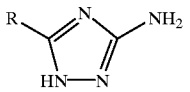

wherein R is a linear or branched, saturated or unsaturated, optionally hydroxy- or alkoxyl-substituted alkyl group containing 1 to 15 carbon atoms or an aryl, furyl, tetrahydrofuryl, thienyl, pyridyl, pyrrolidinyl, 5-oxo-2-pyrrolidinyl, pyrryl, imidazolyl or pyrimidyl group optionally substituted by hydroxy groups, primary, secondary or tertiary amino groups, alkoxy, alkylthio or thiol groups, and salts thereof; and b. an alkali metal sulfate, wherein the weight ratio of alkylaminotriazole compound to alkali metal sulfate is 1:100 to 2:1 and wherein the component has a particle size of 0.01 to 2 millimeters.

14. A dishwashing detergent comprising 1% to 40% by weight of the component of claim 13.

15. A dishwashing detergent comprising 1% to 40% by weight of a component consisting essentially of:

a. 0.001% to 33% by weight of an alkylaminotriazole compound of the formula (I):

(I)

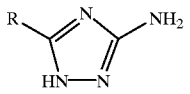

wherein R is propyl, butyl, pentyl, heptyl, octyl, nonyl, decyl, undecyl, dodecyl, isononyl, versatic-10-acid alkyl, phenyl, p-tolyl, (4-tert.butylphenyl), (4-methoxyphenyl), (2-, -3-, 4-pyridyl), (2-thienyl), 5-(methyl-2-furyl), or 5-(oxo-2-pyrrolidinyl), and salts thereof with an acid selected from the group consisting of hydrochloric acid, sulfuric acid, phosphoric acid, carbonic acid, sulfurous acid, acetic acid, glycolic acid, citric acid, and succinic acid; and b. an inorganic alkali metal sulfate, wherein the weight ratio of alkylaminotriazole compound to alkali metal sulfate in the component is 1:70 to 3:2 and wherein the component has a particle size of 0.05 to 1.8 millimeters.

* * * * *